US005994014A

United States Patent [19]

Hinch et al.

[11] Patent Number: 5,994,014

[45] Date of Patent: Nov. 30, 1999

[54] PHOTOCONDUCTOR CONTAINING SILICONE MICROSPHERES

[75] Inventors: Garry Dale Hinch, Louisville; Paul Dwight Kemmesat, Longmont; Laura Lee Kierstein, Johnstown; Michael Thomas Moore, Longmont; Michael George Sloan, Longmont, all of Colo.; Karin Ann Voll, Munds Park, Ariz.; Eric Lawrence Ziercher, Lexington, Ky.

[73] Assignee: Lexmark International, Inc., Lexington, Ky.

[21] Appl. No.: 09/024,181

[22] Filed: Feb. 17, 1998

[51] Int. Cl.[6] ..... G03G 5/047

[52] U.S. Cl. ..... 430/59.6; 430/66

[58] Field of Search ..... 430/59.6, 73, 83, 430/66; 399/147

[56] References Cited

U.S. PATENT DOCUMENTS

| | | | |
|---|---|---|---|
| 4,921,769 | 5/1990 | Yuh et al. | 430/64 |
| 5,096,795 | 3/1992 | Yu | 430/59 |
| 5,114,814 | 5/1992 | Sakoh et al. | 430/46 |
| 5,128,227 | 7/1992 | Monbaliu et al. | 430/59 |
| 5,310,612 | 5/1994 | Yashiki | 430/58 |
| 5,324,606 | 6/1994 | Hodumi et al. | 430/59 |
| 5,399,452 | 3/1995 | Takegawa et al. | 430/58 |
| 5,411,826 | 5/1995 | Yashiki | 430/41 |
| 5,464,716 | 11/1995 | Yashiki | 430/41 |
| 5,485,250 | 1/1996 | Kashimura et al. | 355/211 |
| 5,504,558 | 4/1996 | Ikezue | 355/211 |
| 5,846,680 | 12/1998 | Adachi et al. | 430/59 |

FOREIGN PATENT DOCUMENTS

| | | |
|---|---|---|
| 56-117245 | 9/1981 | Japan . |
| 5-181291 | 7/1992 | Japan . |
| 4-324454 | 11/1992 | Japan . |
| 5-142843 | 6/1993 | Japan . |
| 5-165244 | 7/1993 | Japan . |
| 8-328269 | 12/1996 | Japan . |
| 9-15877 | 1/1997 | Japan . |

*Primary Examiner*—John Goodrow

*Attorney, Agent, or Firm*—Jacqueline M. Daspit; John A. Brady

[57] ABSTRACT

An electrophotographic photoconductor containing an aromatic polycarbonate binder resin and silicone microspheres provides improved wear resistance, increased useful life of the photoconductive drum, a high quality image over the life of the photoconductor, and improved coating uniformity.

20 Claims, 7 Drawing Sheets

PHOTOCONDUCTOR CONTAINING SILICONE MICROSPHERES

FIELD OF THE INVENTION

The invention relates to an electrophotographic photoconductor.

BACKGROUND OF THE INVENTION

In organic photoconductor formulations, the wear performance of the photoconductor is a key factor in determining the useful life of the print cartridge. Photoconductor wear comes from many sources in an electrophotographic engine, including photoconductor contact with the cleaner blade, charge roll, and other spacers or seals that may be a part of the print engine. Wear in the transport layer may cause an overall reduction in thickness of the coating, or it may cause a localized defect in the coating at a specific point of contact with another engine component (e.g., a groove cut in the transport coating at the edge of the charge roll). If the coating becomes thinner, its capacitance will increase and several electrophotographic processes can be affected. For example, the transfer of toner from the photoconductor to the paper may degrade, or if the coating wears away completely, toner may develop to the worn spot and create a print defect. Excessive current also may flow in that spot, and components such as the charge roll may fail prematurely from the high current flow. At that point, either the photoconductor or the entire print cartridge must be replaced to obtain original print quality.

The print performance of the photoconductor can change over its useable life as a result of several factors. One of these factors is the discharge voltage effected by the laser print head. The discharge voltage can become higher or lower over the life of the photoconductor, depending upon the materials used in the formulation of the photoconductor. In discharge area development, the discharge voltage decreases (lower negative voltage) and the print becomes darker. In charge area development, the charge voltage increases (higher positive voltage) and the print becomes darker. This is particularly noticeable when the print is in the form of graphics, illustrations, and pictures which require different shades of blacks or greys. The darkening of the print results in loss of the resolution between the different greyscales, and thus print quality is lost.

The wear performance of the photoconductor depends on the mechanical properties of the charge transport layer. The charge transport layer is formulated from two major components: a polymeric binder resin and a charge transport material. The binder resin is chosen to impart the physical durability necessary for an acceptable useful life under the service conditions encountered in copiers and printers. Typically, the polymeric binder resin is doped with the charge transport material, which often acts as a plasticizer, thereby compromising the mechanical properties of the binder.

Aromatic polycarbonates are one class of resins which can be used as binders in the charge transport layer. Two examples of polycarbonate resins that may be used are bisphenol-Z polycarbonate and bisphenol-A polycarbonate. The doped bisphenol-Z polycarbonates are inherently more wear resistant than the doped bisphenol-A polycarbonates. It is nevertheless desirable to use a, bisphenol-A polycarbonate as a binder resin because it is readily commercially available and relatively inexpensive. Until the present invention, however, no one has been able to provide a charge transport formulation which is suitably resistant to surface scratching and wear during the copy or print process and which retains good mechanical and electrical properties as compared with similar charge transport formulations without any wear-improving additive. Further, no one has been able to provide such a charge transport formulation which uses a relatively inexpensive binder resin such as bisphenol-A polycarbonate.

A number of different approaches have been taken to reduce wear in OPC charge transport formulations. One approach is to coat a third layer, typically called an overcoat layer, on top of the charge generation and charge transport layers. The overcoat is typically a very thin (1–2 microns) polymeric layer which contains little or no charge transport dopant and which possesses improved mechanical properties relative to the charge transport layer. There are, however, several drawbacks to using the overcoating approach to improve wear. First, an additional step in the organic photoconductor coating process adds significant cost to the finished photoconductor. Also, it is difficult to coat an additional layer on top of the charge transport layer without partially dissolving it; this difficulty can be overcome by the proper choice of solvents for the overcoating material, or by utilizing a different coating method (e.g., spray coating) for the overcoat. Nevertheless, an additional coating step (and possibly additional coating equipment) still will add to the expense of the finished organic photoconductor. Finally, it is difficult to add an insulative coating to the photoconductor surface without changing its fundamental electrostatic performance. Typically, addition of an overcoat layer causes a loss of residual voltage and/or an overall reduction in sensitivity. The addition of an overcoat also may change the performance of the photoconductive drum, either electrically or mechanically, at extreme environmental conditions (i.e., high or low ranges of temperature or humidity).

Another approach to reducing charge transport layer wear is to add materials directly to the transport formulation that will modify the mechanical properties of the coating. This provides the advantage of not requiring an additional step in the drum coating process. A number of different materials have been used in this manner, including fluoropolymer particles, inorganic oxides, and various types of silicone oils. The potential disadvantage to this method is that the fundamental properties of the charge transport layer may be changed by the presence of the additive. Similar to the overcoating layers, whatever method is used to improve wear properties should have little or no effect on the electrostatic properties of the photoconductive drum. A change affecting the hardness of the formulation may also affect the attraction of toner to the drum, or may lead to incomplete cleaning of the drum (fused-on-toner). If either the electrical or mechanical properties of the drum are changed, it will likely be manifested in print quality changes that can be directly related to the presence of the additive.

SUMMARY OF THE INVENTION

An object of the invention is to provide a photoconductor having a charge transport formulation which reduces wear and lengthens the useful life of a photoconductive drum.

Another object of the invention is to provide a photoconductor having a charge transport formulation which improves the stability of the photoconductor and its ability to maintain image quality and avoid changing print density (image darkening or lightening) over the life of the print cartridge.

Another object of the invention is to provide a photoconductor having a charge transport formulation which improves the coating thickness uniformity of the charge transport layer.

Another object of the invention is to improve wear resistance, maintain a high quality image over the life of the photoconductor, and improve coating uniformity, without adversely affecting other performance characteristics of the photoconductor, including print quality and electrostatic properties.

Another object of the invention is to provide a wear resistant charge transport formulation that utilizes a relatively inexpensive binder resin, such as bisphenol-A polycarbonate.

These and other objects may be accomplished by the following invention:

According to the present invention, there is provided a wear resistant electrophotographic photoconductor containing an aromatic polycarbonate and silicone microspheres. The photoconductor is preferably a multilayer photoconductor in which at least one layer of the photoconductor contains an aromatic polycarbonate and silicone microspheres. More preferably, the layer containing the silicone microspheres is the outermost layer of the photoconductor and also contains a charge transport material. The aromatic polycarbonate is preferably a bisphenol-A polycarbonate. The silicone microspheres preferably have a mean particle diameter of about 0.5 to about 12.0 microns, more preferably about 1.0 to about 3.0 microns. The at least one layer preferably contains about 0.5% to about 10.0% silicone microspheres, as a weight percent of total solids in the charge transport layer, more preferably about 2.0% to about 5.0%. The charge transport material is preferably N,N'-bis(3-methylphenyl)-N,N'-diphenylbenzidine. The silicone microspheres are preferably dispersed uniformly throughout the charge transport layer.

The use of silicone microspheres provides significant advantages in wear reduction and useful life of the photoconductor, coating uniformity, and maintenance of print quality over life without adversely affecting other key performance characteristics of the photoconductor, including print quality and electrostatic properties.

DETAILED DESCRIPTION OF THE INVENTION

Figure 1:
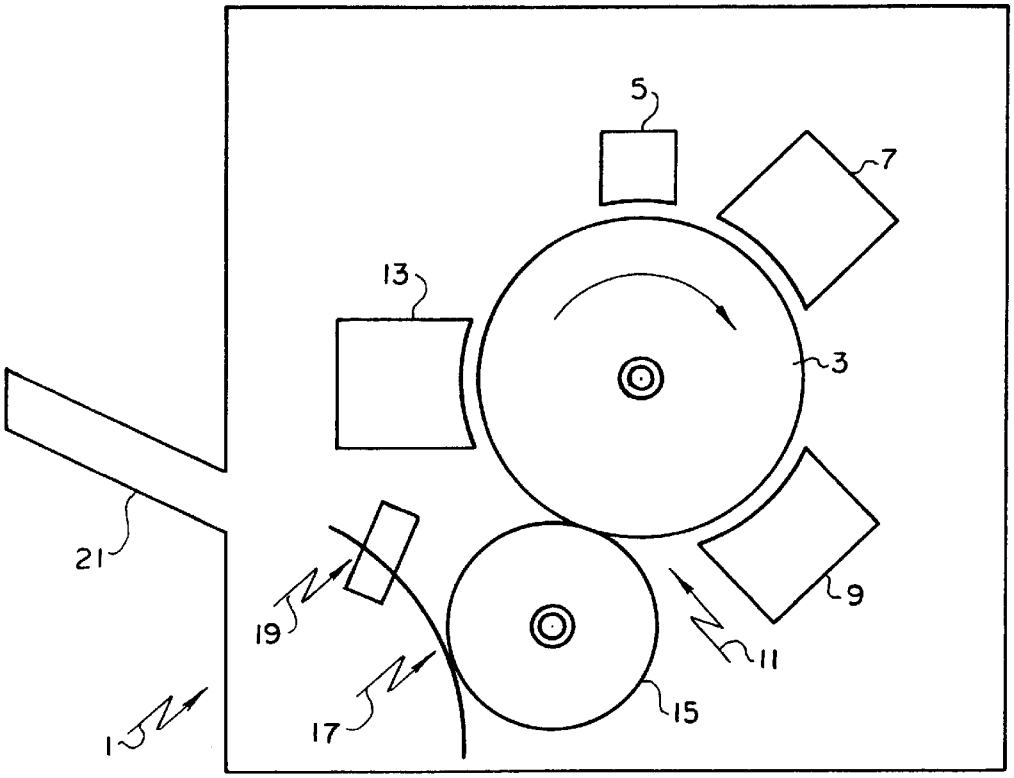
FIG. 1 is a schematic illustration of an electrophotographic imaging apparatus in which the present invention can be implemented.

The present invention may be implemented in a conventional electrophotographic imaging apparatus, such as that illustrated schematically in FIG. 1. FIG. 1 shows an electrophotographic imaging apparatus 1, such as a laser printer, having a cylindrical photoconductive drum 3, which rotates in the clockwise direction. Positioned around drum 3 are, for example, in sequence, a charging station 5, a laser imaging station 7, a toner developing station 9, a transfer station 11, and a cleaning station 13. At charging station 5, drum 3 is uniformly charged, for example, by means of a charge roll. The laser imaging station 7 applies light in an image pattern to the charged surface of drum 3, thereby discharging the drum in the pattern of that image. The developing station 9 applies a toner to the imagewise charged drum to create a toned image. At transfer station 11, the toned image is transferred to intermediate transfer member 15 and then subsequently transferred onto paper 17 or other final substrate, which is then fixed by heat at a fixing station 19 and ultimately delivered out of the imaging apparatus to a tray 21. Alternatively, at transfer station 11, the toned image can be transferred directly onto paper or other final substrate. At cleaning station 13, excess toner remaining on the drum after the image is transferred is removed. This is typically accomplished by means of a cleaner blade which contacts the drum and scrapes off the excess toner. Cleaning station 13 may also include an erase lamp (not shown) for discharging residual charge. Photoconductor wear is caused by contact between drum 3 and the various devices positioned around the drum, such as the developing station, transfer station, cleaner blade, charge roll, and other spacers or seals that may be a part of the imaging apparatus.

The invention is preferably implemented in conjunction with a dry magnetic or nonmagnetic toner. The toner is preferably free of abrasive carrier particles. A preferred toner composition is as follows:

| Toner Component | Wt. Percent |
|---|---|
| styrene acrylic copolymer | 50%–60% |
| synthetic magnetite | 40%–48% |
| wax (homopolymer of propylene or ethylene | 0.5%–2% |
| charge control agent | 0.5%–2% |

To this composition is added 0.5 to 2 percent by weight of fumed silica which has been rendered hydrophobic by surface treatment. An example of such a toner is Lexmark Optra N toner.

Photoconductors typically operate by means of charge generation and charge transport. The charge-generating material and charge-transporting material can occur in a single layer. More commonly, organic photoconductors include multiple layers in which the charge generating material is in a different layer from the charge transporting material. In a conventional dual layer photoconductor, the charge generation layer is located beneath the charge transport layer. In a reverse layer photoconductor, the charge generation layer is located on top of the charge transport layer.

Figure 2:
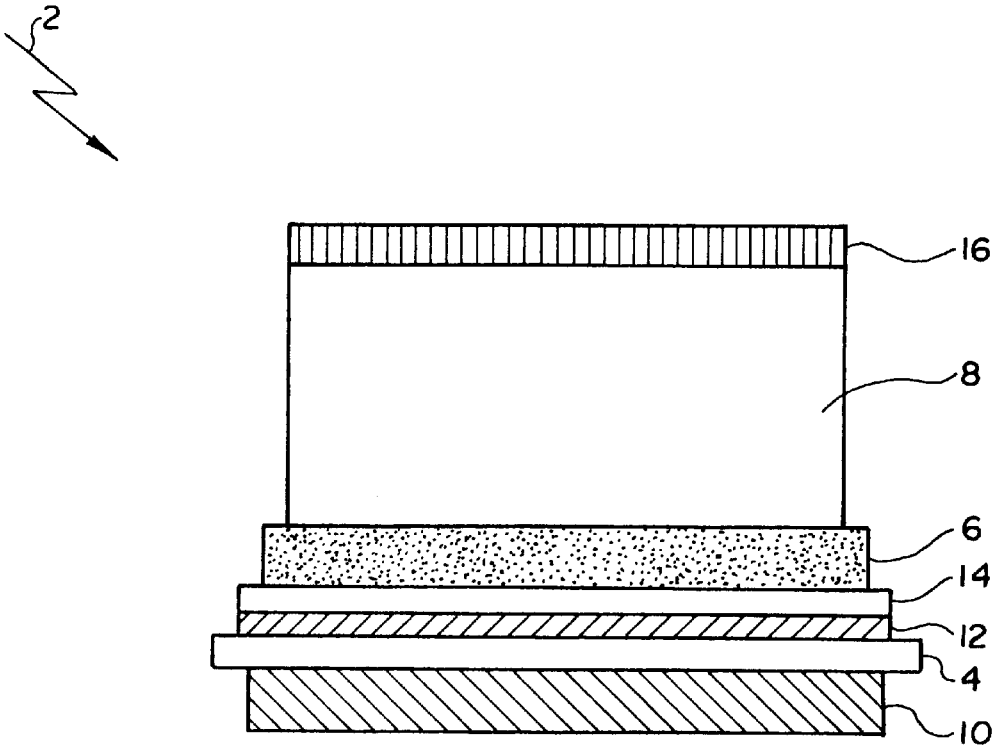
FIG. 2 is a schematic cross-sectional illustration of a photoconductor in which the present invention can be implemented.

Preferably, the invention may be implemented in a conventional multilayer photoconductor, such as that illustrated in FIG. 2. FIG. 2 shows a cross-section of a photoconductor which is disposed, for example, on the outer cylindrical surface of photoconductive drum 3 (FIG. 1). In FIG. 2, photoconductor 2 has a conductive substrate 4, which is then coated with a charge generation layer 6 and a charge transport layer 8, in that order. The charge generation layer 6 absorbs light and, as a result thereof, generates electron-hole pairs, whereas the charge transport layer 8 assists in the migration of charge to the photoconductor surface. The photoconductor optionally may include a mechanical substrate 10 beneath the conductive substrate 4; a barrier or blocking layer 12 on top of the conductive substrate 4; an adhesion or subbing layer 14 beneath the charge generation layer 6; and/or an overcoat layer 16 on the top surface of the charge transport layer 8. (Although the present invention avoids the necessity for an overcoat layer to reduce wear, such a layer is not outside the scope of the invention.) Representative materials used for the construction of these various layers of organic photoconductors are described in the following references: P. Gregory, "Electrophotography," *High-Technology Applications of Organic Colorants*, Chapter 7, pp. 59–87 (Plenum Press, 1991); A. Kakuta, "Laser Printer Application," Masaru Matsuoka, ed., *Infrared Absorbing Dyes*, Chapter 12, pp. 155–171 (Plenum Press, 1990), which are incorporated herein by reference.

The selection of the conductive substrate 4 is not critical to the invention and is well known to those skilled in the art. The conductive substrate 4 may be, for example, an anodized aluminum cylinder. Alternatively, a mechanical substrate 10, such as a flexible sheet of polyethylene terephthalate of the Mylar brand, may be coated with a thin, uniform layer (e.g., about 0.01 to about 0.05 microns) of a conductive material, such as metallic aluminum.

The composition and preparation of the charge generation layer 6 is likewise not critical to the invention and is well known to those skilled in the art. Assuming no barrier or subbing layers are used, the conductive layer 4 is coated with a thin, uniform thickness of a charge generation layer 6 containing a polymeric binder and a photosensitive molecule. The charge generation layer 6 is about 0.1 to about 1.0 microns thick. As a polymeric binder, there may be used, for example, polyvinyl butyral. Other materials that are useful as binders are described in the above-named references and are well known in the art. As a photosensitive molecule, there may be used organic dyes, such as squaraines, phthalocyanines, azo pigments, perylene bisimides, perylene bisimidazoles, and chlorodiane blue. The preferred photosensitive molecules are type I and type IV titanyl phthalocyanines [O═Ti(pc)]. The pigment:binder weight ratio of the phthalocyanine-based charge generation formulations can be varied from 30:70 to 60:40 to vary the photosensitivity. The percent solids of the charge generation formulation can also be varied (typically from 2.5 to 3.5% by weight) to adjust coating thickness. The preparation of the dispersion can be carried out using conventional milling techniques, including paint shakers and media mills. The charge generation layer may be formed using conventional dip-coating methods. Dip-coating apparatus are described in: M. Aizawa and D. S. Gakkaishi, *Electrophotography*, vol. 28, p. 186 (1989); P. M. Borsenberger and D. S. Weiss, *Organic Photoreceptors for Imaging Systems*, p. 294 (Marcel Dekker, Inc. 1993), which are incorporated herein by reference.

A photoconductor optionally may include a barrier or blocking layer 12 to prevent the injection of charge carriers from the charge generation layer 6 to the conductive substrate, which can be a major source of dark decay. Optionally, the photoconductor also may include an adhesion or subbing layer 14 to promote adhesion between the core and charge generation layer 6 and charge transport layer 8. Optionally, the photoconductor also may include an overcoating layer 16 to protect the charge generation layer and charge transport layers from mechanical wear. Such barrier/blocking, adhesion/subbing, and overcoating layers are described in: Takai et al., U.S. Pat. No. 5,194,354; Maruyama et al., U.S. Pat. No. 5,455,135; and R. B. Champ and D. A. Stremel, *IBM Technical Disclosure Bulletin*, No. 30, pp. 146, 375 (1988), which are incorporated herein by reference.

Finally, the charge generation layer 6 is coated with a thin, uniform thickness of a charge transport layer 8 containing a polymeric binder and a charge transport molecule. Charge transport layer 8 is about 20 to about 30 microns thick.

According to the present invention, the preferred polymeric binder is an aromatic polycarbonate having a number average molecular weight of about 20,000 to about 100,000. Examples of aromatic polycarbonates include the following:

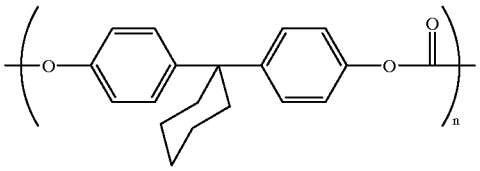

bisphenol-Z polycarbonate

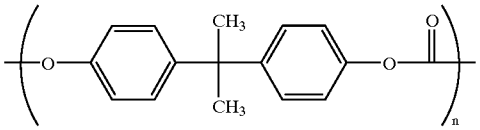

bispenol-A polycarbonate

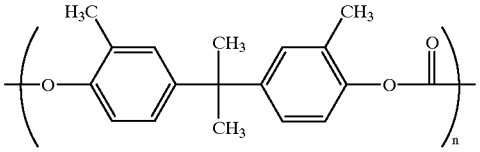

bispenol-C polycarbonate

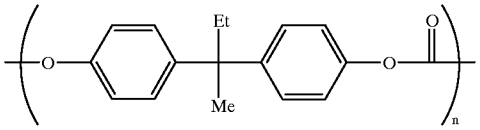

bispenol-B polycarbonate

The most preferred polymeric binder is bisphenol-A polycarbonate.

The selection of a charge transport molecule is not critical to the invention, and the useful molecules are well known to those skilled in the art. As a charge transport molecule, there may be used, for example, triarylamines, benzidines, triphenylmethanes, stilbenes, hydrazones, and butadienes. According to the present invention, the preferred charge transport molecule is N,N'-bis(3-methylphenyl)-N,N'-diphenylbenzidine, which has the following chemical formula:

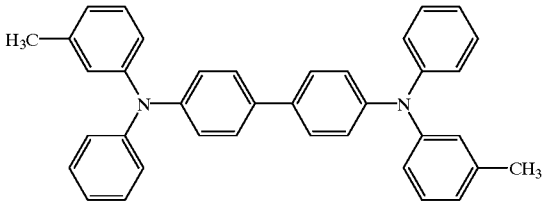

According to the present invention, silicone microspheres are added to the charge transport formulation to improve wear resistance, increase the useful life of a photoconductive drum, maintain a high quality image over the life of the photoconductor, and improve coating uniformity. One example of the silicone microspheres that can be used is Tospearl brand microspheres manufactured by Toshiba/GE Silicones. The Tospearl silicone microspheres have a network structure with siloxane bonds extending three-dimensionally. The chemical structure of the Tospearl microspheres is illustrated schematically below:

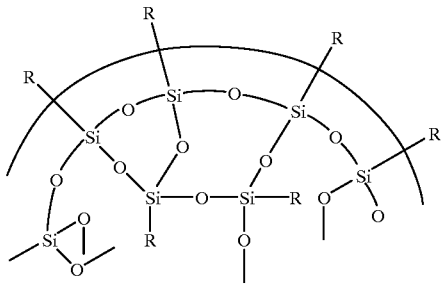

where R represents a methyl group.

Preferably, the silicone microspheres are spherical and have a mean particle diameter of about 0.5 to about 12.0 microns, more preferably about 1.0 to about 3.0 microns. The lower particle sizes tend to have a lesser impact on wear, while the higher particle sizes tend to be more susceptible to toner filming in certain applications.

Preferably, the silicone microspheres are added to the charge transport formulation in an amount equal to about 0.5% to about 10% by weight of the total solids in the charge transport formulation, more preferably about 2.0% to about 5.0%. This more preferred concentration range shows the maximum improvement in wear resistance. Higher concentrations seem to have a greater susceptibility to toner filming and show little further improvement in wear reduction.

The silicone microspheres are added directly to and dispersed in the charge transport formulation. The microspheres are insoluble in common coating solvents, such as tetrahydrofuran. The charge transport layer may be formed using conventional dip-coating methods as described, for example, in the above-named references.

The coatings produced from charge transport formulations containing silicone microspheres have excellent thickness uniformity and coating quality compared to control formulations not containing the microspheres. The wear rate of the formulations containing microspheres is decreased as measured by the weight of the coating lost as the drum is operated in a printer. This translates into increased life of the drum before print quality failure due to wear-related drum defects. Finally, there are no electrical or print quality differences that can be traced to the addition of the microspheres to the charge transport formulation, as long as the concentration of the microspheres is held within the limits described above.

The above description and figures as well as the examples below illustrate certain preferred embodiments which achieve the objects, features and advantages of the present invention. It is not intended that the present invention be limited to these embodiments. Any modifications of the present invention which come within the spirit and scope of the appended claims should be considered part of the invention. For example, a single layer or dual inverted layer photoconductor comprising an aromatic polycarbonate binder resin and silicone microspheres is included within the scope of this invention.

EXAMPLE 1

Preparation of Charge Generation Layer 3.69 g polyvinylbutyral (S-Lec BX55Z, Sekisui Chemical, Osaka, Japan) is dissolved in a mixture of 41.75 g cyclohexanone and 18.76 g 2-butanone. Preparation of the dispersion mill base is completed by adding 7.84 g type I O═Ti(pc) (titanyl phthalocyanine, ProGen 2MS, Zeneca Specialties, Manchester, United Kingdom) to the binder solution and mixing on a paint shaker for 4 hours. The mill base is added to a sand mill (Model K50, Eiger Machinery Inc., Chicago, Ill.) and milled at 2500 rpm for 3 hours with 1.0 mm glass beads. A let down solution is prepared by addition of 1.54 g polyvinylbutyral to a mixture of 0.48 g cyclohexanone and 361.35 g 2-butanone. The let down solution is added to the mill base, and recirculated through the mill until mixing is complete. The resulting mixture is then passed through a metal mesh to separate the glass beads from the dispersion. The dispersion is coated onto a substrate (30 mm diameter anodized aluminum cylinder) using a dip coating apparatus to prepare a charge generation layer of about 0.5 micron thickness. The thickness of the charge generation layer may be monitored by measuring the optical density of the coating, using, for example, a Macbeth TR524 densitometer.

Comparative Example 2

Preparation of Charge Transport Layer 28.85 g N,N'-bis(3-methylphenyl)-diphenylbenzidine ("TPD") (Catalogue No. ST 16/1.1; SynTec GmbH, Wolfen, Germany) is added to a mixture of 292 ml tetrahydrofuran and 108 ml 1,4-dioxane and dissolved with vigorous stirring. Once the TPD is completely dissolved, 60.26 g bisphenol-A polycarbonate (Makrolon 5208, Bayer) is also added to the solution, along with 4 drops of DC-200 surfactant (α, ω-bis (trimethylsiloxy) polydimethylsiloxane, Dow Corning) and stirring is continued until all components are completely dissolved. The resulting solution is coated on top of the charge generation layer prepared according to Example 1 using a dip coating apparatus. The charge transport layers prepared in accordance with Comparative Example 2, Examples 3A–P and Comparative Examples 3Q–S have a mean coating thickness that varies from 20 to 30 microns. The thickness of the transport layer is monitored using a contact profilometer (see Example 6, infra).

Examples 3A–P and Comparative Examples 3Q–S

Preparation of Charge Transport Layers Containing Silicone Microspheres

A charge transport formulation is prepared in accordance with Example 2, except that, after all components of the transport solution are completely dissolved, a predetermined amount of silicone microspheres is added, and stirring is continued until the microspheres are uniformly dispersed throughout the charge transport solution. The types, particle sizes, and amounts of silicone microspheres that are added in each Example are set forth in Table I, below. The charge transport formulations are coated in the same manner as in Example 2.

TABLE I

| Example | Type of silicone microspheres | Mean particle diameter[1] | Percent silicone microspheres[2] |
|---|---|---|---|
| 3A | Tospearl 105 | 0.5 microns | 0.7% |
| 3B | Tospearl 105 | 0.5 microns | 5.0% |
| 3C | Tospearl 120 | 2 microns | 1.0% |
| 3D | Tospearl 120 | 2 microns | 3.0% |
| 3E | Tospearl 120 | 2 microns | 5.0% |
| 3F | Tospearl 120 | 2 microns | 7.5% |
| 3G | Tospearl 120 | 2 microns | 10.0% |
| 3H | Tospearl 130 | 3 microns | 0.7% |

TABLE I-continued

| Example | Type of silicone microspheres | Mean particle diameter[1] | Percent silicone microspheres[2] |
|---|---|---|---|
| 3I | Tospearl 130 | 3 microns | 5.0% |
| 3J | Tospearl 130 | 3 microns | 7.5% |
| 3K | Tospearl 130 | 3 microns | 10.0% |
| 3L | Tospearl 145 | 4.5 microns | 0.7% |
| 3M | Tospearl 145 | 4.5 microns | 5.0% |
| 3N | Tospearl 145 | 4.5 microns | 7.5% |
| 3O | Tospearl 145 | 4.5 microns | 10.0% |
| 3P | Tospearl 3120 | 12 microns | 1.0% |
| Comp. 3Q | Tospearl 240 | 4 microns amorphous | 1.0% |
| Comp. 3R | Tospearl 103 | 0.3 microns | 1.0% |
| Comp. 3S | Tospearl 103 | 0.3 microns | 5.0% |

[1]Unless otherwise indicated, silicone microspheres are spherical.
[2]Weight percent of total solids in the charge transport formulation.

EXAMPLE 4

Photomicrographs of Charge Transport Layer Containing Silicone Microspheres

Figure 3A:
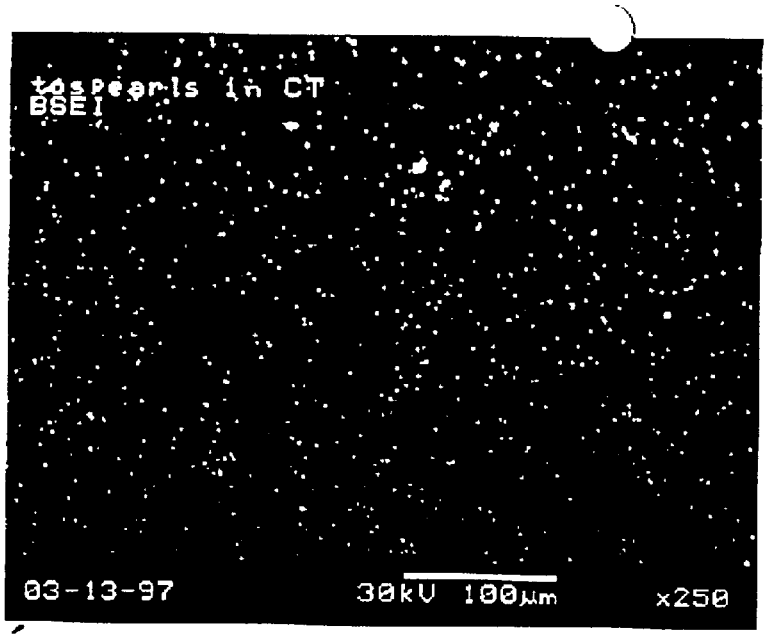
FIGS. 3*a* and 3*b* are scanning electron photomicrographs of charge transport layers containing silicone microspheres according to the invention.
Figure 3B:
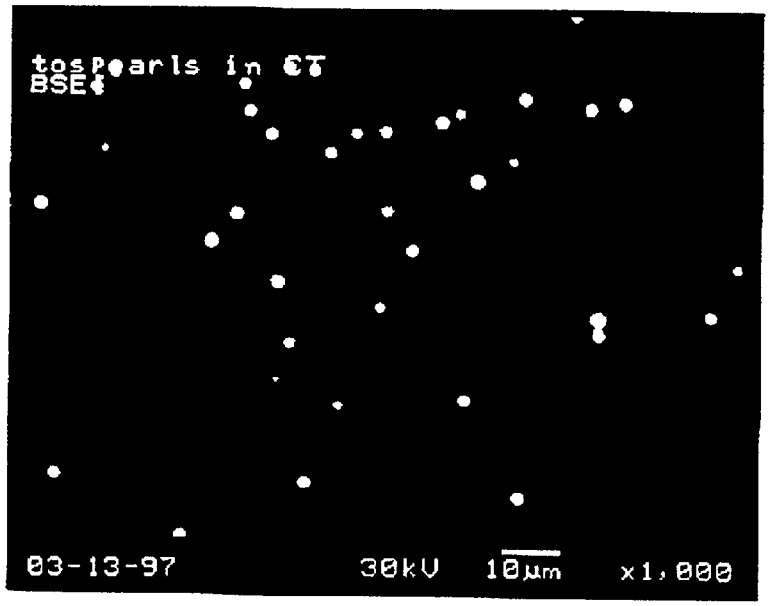

A charge transport layer is prepared in accordance with Example 3C with silicone microspheres at 1% of total solids. For the purpose of preparing a scanning electron micrograph of the change transport layer, the charge transport formulation was coated directly onto a Mylar substrate without any conductive substrate or charge generation layer. The distribution of the microspheres in the coated charge transport layer is characterized by scanning electron microscopy (SEM) using a JEOL 5800 microscope with back scattered electron (BSE) detectors and a 30 kV accelerating voltage. Scanning electron micrographs are prepared at 250× and 1,000× magnification. Copies of the resulting photomicrographs are set forth in FIGS. 3*a* and 3*b*, respectively. For ease of comparison, a scale is shown at the bottom of each photomicrograph (100 microns for FIG. 3*a* and 10 microns for FIG. 3*b*). As shown in the photomicrographs, the silicone microspheres are uniformly distributed throughout the charge transport layer.

EXAMPLE 5

Photosensitivity of Photoconductors with Charge Transport Layer Containing Silicone Microspheres The sensitivity of photoconductive drums prepared in accordance with Examples 3C–E (charge transport layers containing 1%, 3% and 5% by weight of total solids, respectively, of silicone microspheres having a mean particle diameter of 2 microns) and Comparative Example 2 (charge transport layer containing no silicone microspheres) are tested with an electrophotographic parametric tester. The exposure source for the tester is a 780 nm gallium arsenide laser, with exposure energy ranging from 0.0–1.3 $\mu J/cm^2$. Photoconductor charging is carried out via a charge corona, and discharge voltages are measured by Trek electrostatic probes at 169 milliseconds after exposure. A constant temperature chamber is used to house the print engine to ensure isothermal conditions during the measurements. The resulting voltage vs. energy curves are shown in FIG. 4.

Figure 4:
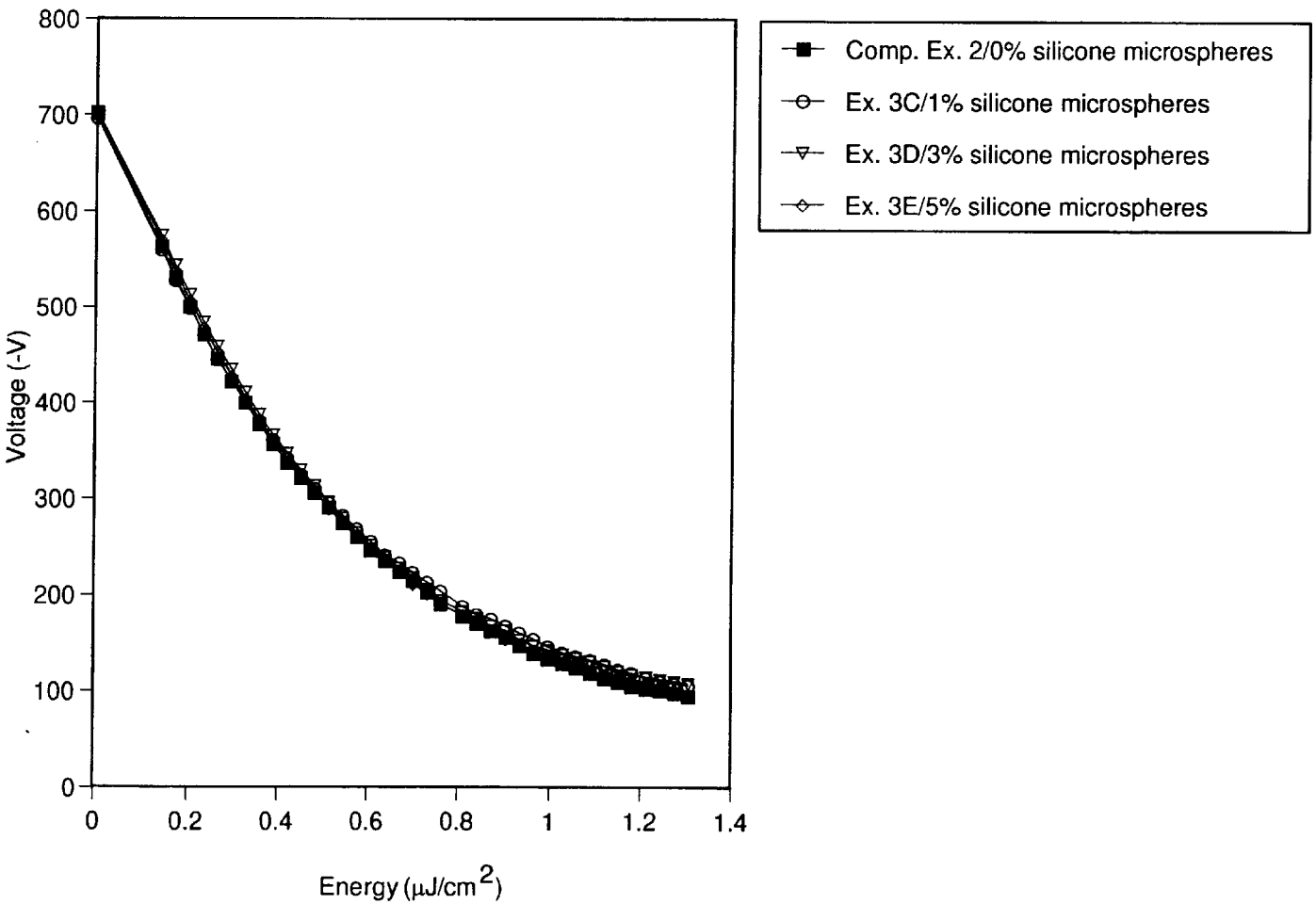
FIG. 4 is a voltage versus energy curve for photoconductive drums having charge transport layers containing varying amounts of silicone microspheres.

As illustrated in FIG. 4, the addition of silicone microspheres has a minimal effect on the sensitivity of the photoconductor at concentrations of 1% to 5% by weight of total solids in the charge transport formulation. The initial electrostatics of the drums are virtually superimposed for this range of concentrations. For higher concentrations (up to 10%) of silicone microsphere loading, the sensitivity falls off slightly, due to the charge transport layer becoming somewhat opaque at higher concentrations.

EXAMPLE 6

Coating Uniformity of Charge Transport Formulations Containing Silicone Microspheres The coating uniformity of charge transport layers prepared in accordance with Examples 3C and 3E (containing 1% and 5% by weight of total solids, respectively, of silicone microspheres having a mean particle diameter of 2 microns) and Comparative Example 2 (containing no silicone microspheres) are tested in the following manner. A thread saturated in tetrahydrofuran is brought into contact with the photoconductor to cut through to the aluminum substrate at various points along the drum. A contact profilometer (Taylor Hobson Form Talysurf Series 2, Model #120i) is used to measure the distance from the top of the charge transport layer to the bottom of the groove cut by the wet string. The resulting thickness profiles are shown in FIG. 5.

Figure 5:
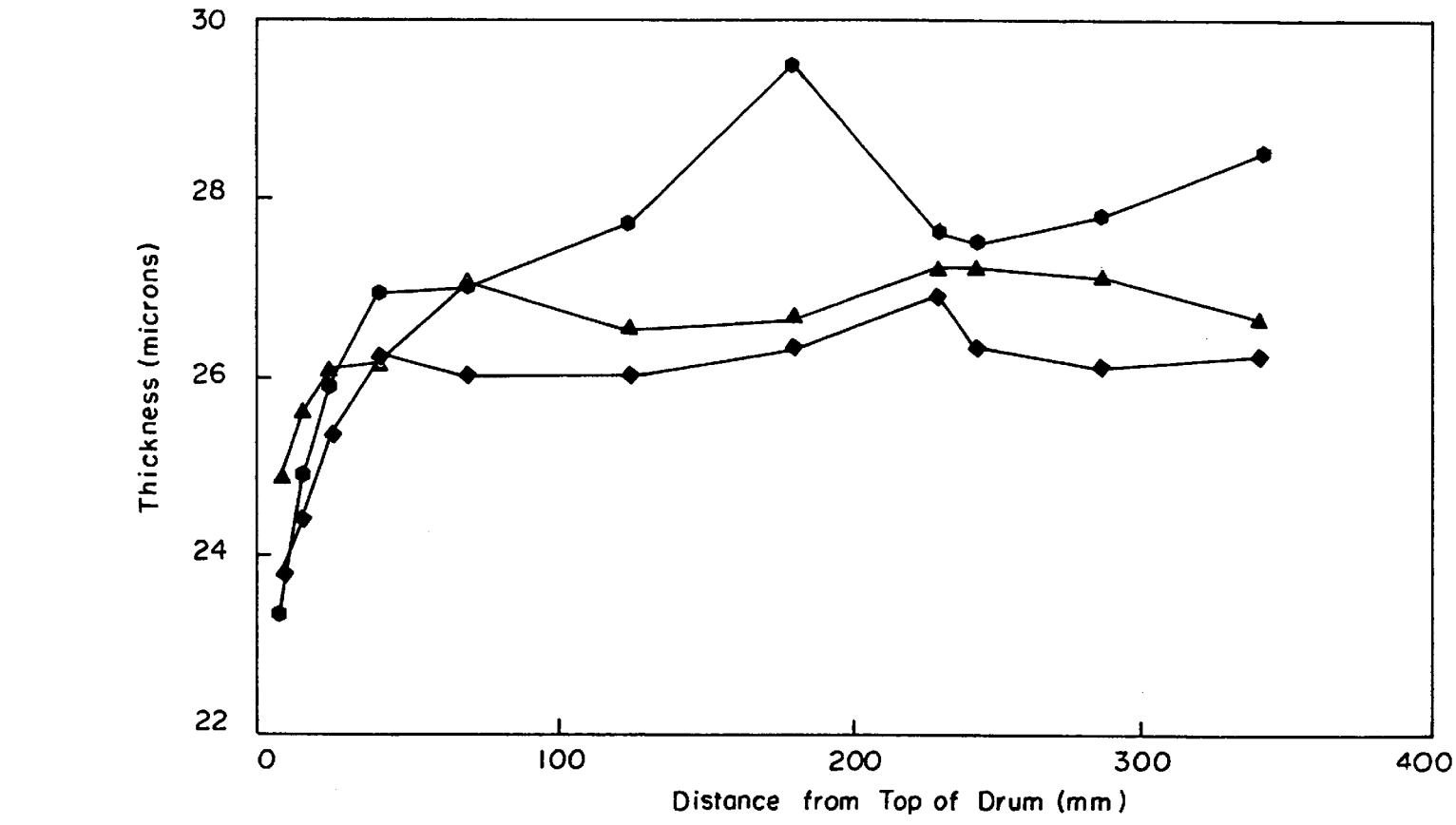
FIG. 5 shows thickness profiles for charge transport layers containing varying amounts of silicone microspheres.

As illustrated in FIG. 5, the addition of silicone microspheres leads to improvement in the coating uniformity of the charge transport layer. The variation in transport layer thickness is minimized by the addition of silicone microspheres, when compared to the charge transport formulation containing no silicone microspheres. In all cases, the transport layer is relatively thin in the first 50 mm at the top of the drum. The formulations containing silicone microspheres have a lower variation in thickness over that range—about 4 microns for Comparative Example 2 (containing no silicone microspheres) versus about 2 microns or less for Examples 3C and 3E (containing 1% and 5% by weight of total solids, respectively, of silicone microspheres having a mean particle diameter of 2 microns). (The "top of the drum" refers to the circular edge of the cylindrical drum which last enters the coating solution in the dip-coating process in which the drum is immersed with its rotational axis perpendicular to the surface of the coating solution.) In addition, the formulations containing silicone microspheres reduce the variation in coating thickness over the rest of the drum from about 4 microns for Comparative Example 2 to about 1 micron for each of Examples 3C and 3E. These improvements in charge transport layer uniformity are significant in that they provide improved print uniformity that can be readily observed in the optical density of greyscale and all- black patterns.

EXAMPLE 7

Wear Reduction in Photoconductors with Charge Transport Layer Containing Silicone Microspheres The reduction in charge transport layer thickness over drum life can give rise to print quality defects or other failures that would end the useful life of a print cartridge. Failures are usually of three types: (1) areas of high background caused by the charge transport layer of the drum becoming too thin to retain the charge required, (2) toner filming, where residual toner is not completely removed from the surface of the photoconductive drum during cleaning and may be fused to the drum, leading to spot defects in printed pages, or (3) a short-circuit between the primary charge roll and the drum core caused by the coating of the drum wearing through, exposing the core to the charge roll.

The useful life and wear rate of photoconductive drums prepared in accordance with Examples 3A–C and 3E–P, and Comparative Examples 3Q–S are measured in the following manner. The drums are assembled into Lexmark Optra N print cartridges and installed in Lexmark Optra N printers. The photoconductor life testing is carried out using single-page print jobs in order to minimize paper cost and provide the most conservative estimate of drum life. For each single job printed, the drum rotates 10.9 times, or roughly 11 rotations per single-page print job. This causes the maximum potential drum wear per page printed. The testing is carried out at 78° F. and 80% relative humidity because in this environment, the drum is the least durable and fails at the earliest print count.

The toner cartridge is filled with 850 grams of Lexmark Optra N toner, and initial electrostatic charge and discharge voltages are measured. The cartridge is conditioned for at least one hour, and then an initial print quality sample is printed. The printer then prints 500 text pages, each containing an average of 2% coverage of the printable area. Another print quality sample is then printed, followed by 500 more text pages. This sequence is repeated until 2000 pages are printed, at which time sample frequency is reduced to one print sample every 2000 pages. This protocol is followed through a 16-hour, two-shift day, followed by 8 hours off time, and repeated each day until the photoconductive drum fails.

The number of pages printed with each photoconductor prior to occurrence of a defect, i.e., the appearance of high background in the print or failure from toner filming, is set forth in Table II, below. (During this testing, no failures occurred due to a short circuit.) In addition, the difference between the starting weight of the photoconductive drum and the end weight after occurrence of a defect is measured and the weight loss is normalized to an average per 1000 pages printed. The resulting weight loss data is also set forth in Table II, below.

TABLE II

| Photoconductor | Mean particle diameter of silicon microspheres[1] | Percent silicone microspheres[2] | Pages printed until occurrence of defect | Weight loss per 1000 pages printed |
|---|---|---|---|---|
| Comp. Ex. 2 | | 0% | 9,623 | 37.22 mg |
| Example 3A | 0.5 microns | 0.7% | 11,106 | 56.60 mg |
| Example 3B | 0.5 microns | 5.0% | 8,243 | 44.32 mg |
| Example 3C | 2 microns | 1.0% | 14,500 | 29.98 mg |
| Example 3E | 2 microns | 5.0% | 18,461 | 18.28 mg |
| Example 3F | 2 microns | 7.5% | 19,435 | 19.83 mg |
| Example 3G | 2 microns | 10.0% | 18,035 | 19.76 mg |
| Example 3H | 3 microns | 0.7% | 11,286 | 35.70 mg |
| Example 3I | 3 microns | 5.0% | 8,459 | 21.39 mg |
| Example 3J | 3 microns | 7.5% | 19,839 | 18.38 mg |
| Example 3K | 3 microns | 10.0% | 21,605 | 19.60 mg |
| Example 3L | 4.5 microns | 0.7% | 21,208 | 24.74 mg |
| Example 3M | 4.5 microns | 5.0% | 8,547[3] | 28.90 mg |
| Example 3N | 4.5 microns | 7.5% | 8,543[3] | 14.19 mg |
| Example 3O | 4.5 microns | 10.0% | 8,173[3] | 16.59 mg |
| Example 3P | 12 microns | 1.0% | 9,468 | 43.33 mg |
| Comp. Ex 3Q | 4 microns, amorphous | 1.0% | 7,518 | 38.76 mg |
| Comp. Ex 3R | 0.3 microns | 1.0% | 1,000 | 55.10 mg |
| Comp. Ex 3S | 0.3 microns | 5.0% | 4,550 | 50.24 mg |

[1]Unless otherwise indicated, silicone microspheres are spherical.
[2]Weight percent of total solids in the charge transport formulation.
[3]Failure from toner filming -- all other failures from high background (wear).

As is illustrated in Table II, the wear rate is significantly improved with the addition of 1% to 5% silicone microspheres (by weight of total solids in the charge transport formulation) having a particle size of 2 to 4.5 microns. The wear rate appears to plateau as higher concentrations are used (greater than 5%). Table II also shows that the useful drum life can be increased dramatically by addition of silicone microspheres to the transport formulation, up to a factor of two in pages printed before a defect (increased background or toner filming) is observed.

EXAMPLE 8

End Wear in Photoconductors with Charge Transport Layer Containing Silicone Microspheres The catastrophic problem of end wear occurs when the photoconductor coating wears away completely, exposing the bare core. This can cause the charge roll to short out, allow excessive current to flow, and lead to a premature charge roll failure and/or cause background in prints due to low charging adjacent to the shorted region.

Figure 6:
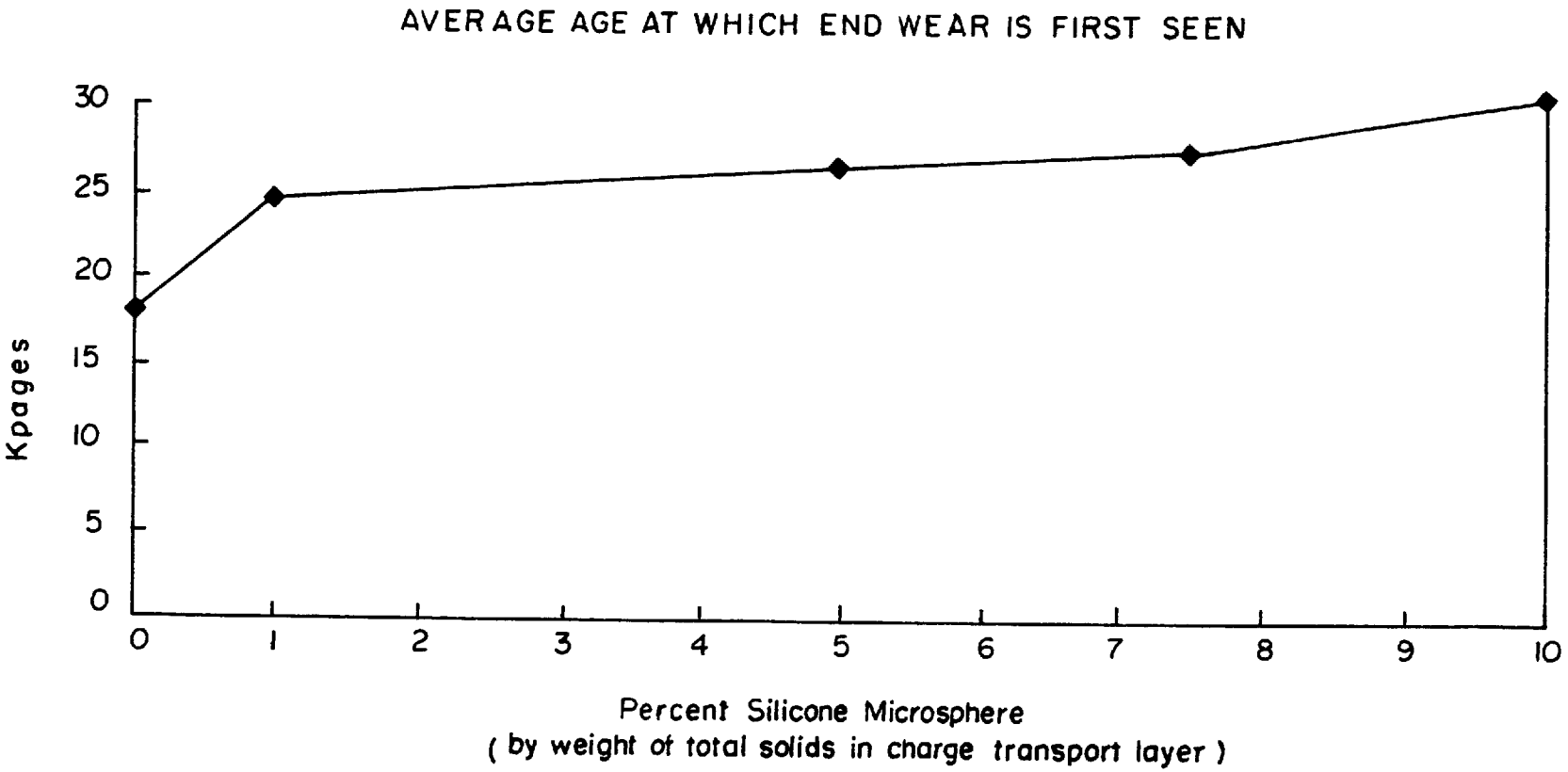
FIG. 6 is a graphic illustration of the average age at which end wear is first observed in photoconductors having charge transport layers containing varying amounts of silicone microspheres.

Photoconductive drums prepared in accordance with Examples 3C, 3E, 3F and 3G (charge transport layers containing 1%, 5%, 7.5% and 10% by weight of total solids, respectively, of silicone microspheres having a mean particle diameter of 2 microns) and Comparative Example 2 (charge transport layer containing no silicone microspheres) are tested for end wear. In this test, the drums are assembled into standard Lexmark Optra S print cartridges and installed in Lexmark Optra S printers. The toner cartridges are filled with Lexmark Optra S toner. Print samples are taken on a regular basis to assess cartridge performance: at the start of the day (SOD), the end of the day (EOD), and every time the page count reaches a multiple of 2000 pages. Four-page print jobs are run so that there is a short pause between jobs. These jobs are run continuously at 24 ppm for roughly ten hours a day to age the cartridge. The test is run until text breakup is observed due to low toner. Multiple cartridges and printers are used to allow averaging across several data points per formulation. With respect to end wear, the entire drum surface is visually examined every time a print sample is taken, and the page count noted when a wear spot gets deep enough to reach the core (bare aluminum is seen). In FIG. 6, the average age at which end wear is first seen in the drum is plotted vs. the percent loading of silicone microspheres in the charge transport layer.

As shown in FIG. 6, adding silicone microspheres to the charge transport layer increases the number of pages that can be printed prior to the occurrence of end wear. At concentrations of about 2% to about 8% (by weight of total solids in the charge transport formulation), end wear is delayed by roughly 7000 pages compared to charge transport layers containing no silicone microspheres.

EXAMPLE 9

Optical Density using Photoconductors having Charge Transport Layer Containing Silicone Microspheres The print optical density—a measure of print darkness—of photoconductive drums prepared in accordance with Examples 3C and 3D are measured (charge transport layers containing 1% and 3% by weight of total solids, respectively, of silicone microspheres having a mean particle diameter of 2 microns). The same general procedure described in Example 8 is used in this test. SOD and EOD print samples are selected and an optical density measurement made on an all-black print. The optical density measurement is made with a Minolta CM-2002 spectrophotometer set to specular-excluded mode; the system is calibrated before each measurement and the optical density measured by averaging the readings for five large black boxes. The all-black optical density vs. the number of pages printed is plotted in FIG. 7. The solid and dashed lines are a linear fit through the data for the 3% and 1% microsphere loadings, respectively.

Figure 7:
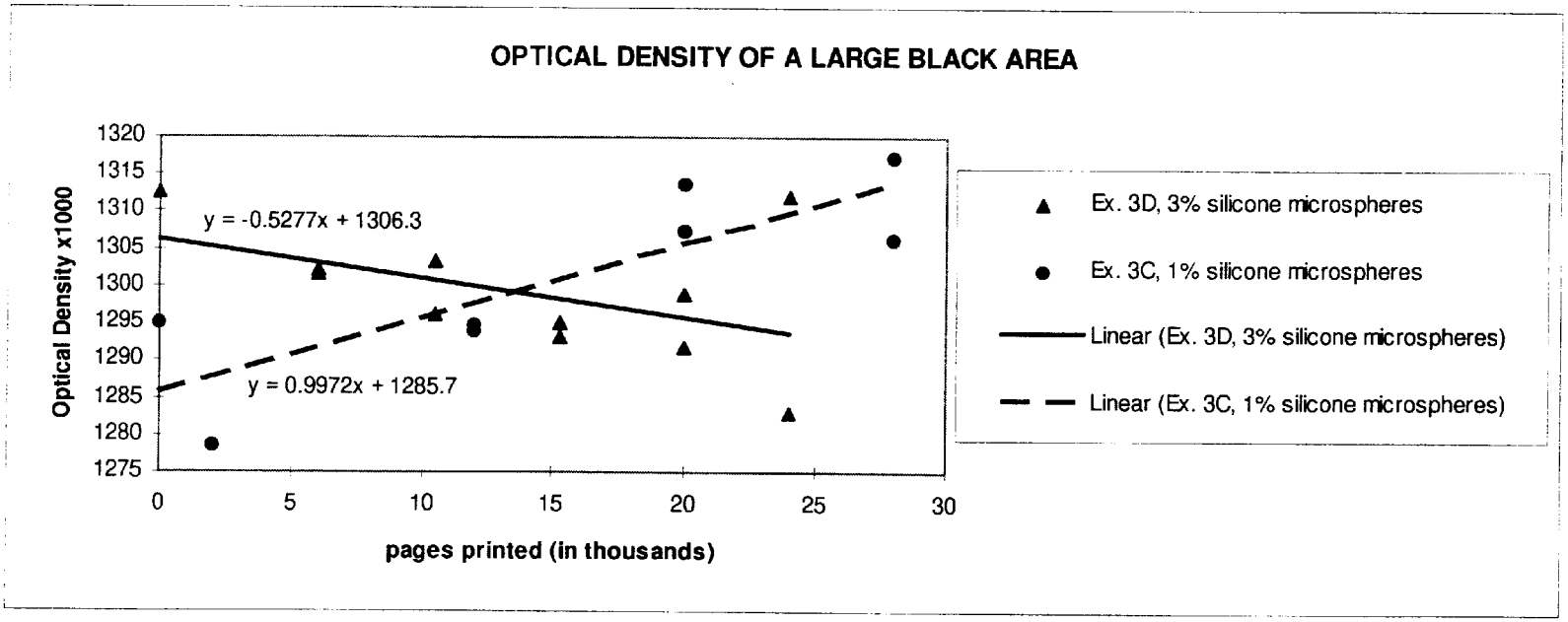
FIG. 7 is a graphic illustration of the print optical density over the life of photoconductive drums having charge transport layers containing varying amounts of silicone microspheres.

It is well known that the print density may change over the life of a conventional photoconductor due to a gradual increase or decrease in photoconductor sensitivity. As shown in FIG. 7, the print darkens only to a slight degree over life for Example 3C containing 1% silicone microspheres (by weight of solids in the charge transport layer). In Example 3D, the addition of 3% silicone microspheres (by weight of total solids in the charge transport layer) reverses the darkening trend to a lightening trend. By interpolation, 2.3% silicone microspheres (by weight of total solids in the charge transport layer) is the optimum amount for minimizing print darkening over the life of the photoconductor. Thus, the addition of silicone microspheres to the charge transport formulation leads to an unexpected benefit with respect to the print stability over the life of the photoconductive drum.

We claim:

1. An electrophotographic photoconductor comprising:

(a) an aromatic polycarbonate; and (b) silicone microspheres.

2. A photoconductor according to claim 1, wherein said photoconductor is a multilayer photoconductor and wherein at least one layer of said photoconductor comprises an aromatic polycarbonate and silicone microspheres.

3. A photoconductor according to claim 2, wherein said at least one layer is the outermost layer of the photoconductor.

4. A photoconductor according to claim 2, wherein said at least one layer further comprises a charge transport material.

5. A photoconductor according to claim 1, wherein said aromatic polycarbonate is a bisphenol-A polycarbonate.

6. A photoconductor according to claim 1, wherein said silicone microspheres have a mean particle diameter of about 0.5 to about 12.0 microns.

7. A photoconductor according to claim 2, wherein said at least one layer comprises about 0.5% to about 10.0% silicone microspheres, as a weight percent of total solids in the layer.

8. An electrophotographic photoconductor having a charge transport layer comprising:

(a) an aromatic polycarbonate;

(b) a charge transport material; and (b) silicone microspheres.

9. A photoconductor according to claim 8, wherein said charge transport layer is the outermost layer of the photoconductor.

10. A photoconductor according to claim 8, wherein said charge transport material is N,N'-bis(3-methlyphenyl)-N,N'-diphenylbenzidine.

11. A photoconductor according to claim 8, wherein said aromatic polycarbonate is a bisphenol-A polycarbonate.

12. A photoconductor according to claim 8, wherein said silicone microspheres have a mean particle diameter of about 0.5 to about 12.0 microns.

13. A photoconductor according to claim 8, wherein said silicone microspheres have a mean particle diameter of about 1.0 to about 3.0 microns.

14. A photoconductor according to claim 8, wherein said charge transport layer comprises about 0.5% to about 10.0% silicone microspheres, as a weight percent of total solids in the layer.

15. A photoconductor according to claim 8, wherein said charge transport layer comprises about 2.0% to about 5.0% silicone microspheres, as a weight percent of total solids in the layer.

16. A photoconductor according to claim 8, wherein said silicone microspheres are dispersed uniformly throughout said at least one layer.

17. An electrophotographic photoconductor having a charge transport layer comprising:

(a) bisphenol-A polycarbonate;

(b) a charge transport material; and (c) silicone microspheres having a mean particle diameter of about 0.5 to about 12.0 microns.

18. An electrophotographic imaging apparatus comprising a photoconductor according to claim 1.

19. An electrophotographic imaging apparatus comprising a photoconductor according to claim 8.

20. An electrophotographic imaging apparatus comprising a photoconductor according to claim 17.

* * * * *